US006020852A

United States Patent [19]

Jostell

[11] Patent Number: 6,020,852

[45] Date of Patent: Feb. 1, 2000

[54] ANTENNA ELEMENT FOR TWO ORTHOGONAL POLARIZATIONS

[75] Inventor: Ulf Jostell, Mölndal, Sweden

[73] Assignee: Saab Ericsson Space AB, Göteborg, Sweden

[21] Appl. No.: 08/952,557

[22] PCT Filed: Apr. 29, 1996

[86] PCT No.: PCT/SE96/00561

§ 371 Date: Nov. 5, 1997

§ 102(e) Date: Nov. 5, 1997

[87] PCT Pub. No.: WO96/35240

PCT Pub. Date: Nov. 7, 1996

[30] Foreign Application Priority Data

May 5, 1995 [SE] Sweden ..... 9501669

[51] Int. Cl.[7] ..... H01Q 1/38

[52] U.S. Cl. ..... 343/700 MS; 343/864

[58] Field of Search ..... 343/846, 700 MS, 343/864; H01Q 1/38

[56] References Cited

U.S. PATENT DOCUMENTS 5,539,420 7/1996 Dusseux et al. ..... 343/700 MS

FOREIGN PATENT DOCUMENTS 0247454 12/1987 European Pat. Off. .
0449492 2/1995 European Pat. Off. .
WO 95/09455 4/1995 WIPO .

*Primary Examiner*—Michael C. Wimer
*Attorney, Agent, or Firm*—Pollock, Vande Sande & Amernick

[57] ABSTRACT

An antenna element intended for transmission and reception of orthogonal polarizations having a good polarization purity of electomagnetic radiation is described. It comprises a ground plane (2) and at least one radiation disc (1) connected to two ports (4, 5) for the supply of a desired electromagnetic radiation, preferably in the microwave range. The distance between the ground plane (2) and the radiation disc (1) is a fraction of the wavelength λ of the radiation. The antenna element is in particular characterized in that the ports (4, 5) are located at an electric distance of 90° from each other and that a quarterwave transformer (6) is added between the ground plane (2) and the radiation disc (1) that is shaped so that the transmission line impedance between the ports (4, 5) is reduced in order to make the ports radiationally independent of each other.

15 Claims, 1 Drawing Sheet

ANTENNA ELEMENT FOR TWO ORTHOGONAL POLARIZATIONS

FIELD OF THE INVENTION

The present invention relates to an antenna element intended for transmission and reception of electromagnetic radiation having two orthogonal polarizations having a good purity of polarisation.

BACKGROUND OF THE INVENTION

Antenna elements of the kind that includes the present invention are called micro strip antennas or patch antennas and constitute an all round class of antenna elements. Hence, the basic building block of these antennas is a radiation disc in the shape of a flat, metallic plate. The plate was a shape that, in principle, is arbitrary, that is a patch, separated from a ground plane by means of air or a dielectric. By correctly choosing the dimensions of the plate it is made resonant for a chosen electromagnetic radiation frequency. Usually, the frequency, is in the microwave range. The plate can be used for absorbing or radiating energy at this frequency. It is often desirable that the antenna absorbs or radiates radiation solely having a particular polarization. It is required that the antenna has a good purity of polarization (a low cross polarization, a low axial ratio). It is often required that the antenna can obtain two orthogonal polarizations corresponding to two antenna ports, that is, two linear or opposed elliptical, in particular circular polarizations, having a good purity of polarization. It is clear that deviations from a geometrical symmetry can cause degradation of the polarization purity. The supply itself to the radiation disc can cause such an asymmetry. The problem related to polarization purity then becomes pronounced in the case when the antenna element is made a broad band, type since the effect from the supply in this case becomes marked.

A number of different solutions of the problem relating to polarization purity in antenna elements of the above type has been suggested.

The problem of geometrical asymmetry caused by the supply of the radiation disc can be solved by means a balanced supply, but this will add supply points. This is a complication that can not always be accepted. Balanced supply results in a doubling of the number of supply points for the antenna element, an increased complexity and the problem with potential build-up.

Cutting-outs and tongues at the edges of the antenna elements are often used to obtain a circular polarization using only one supply point. In the case of two polarizations they can, in principle, be used in order to improve the polarization purity. In practice it seems to be hard to design such radiation discs having cutting-outs and tongues since they also modify the electric dimensions of the antenna.

If the antenna element is to generate a circular, single or double that is, right and left rotating polarization and a quadrature hybrid is used, unbalance in the hybrid provides a method of improving the polarization purity. Unless circular polarisation is required and the hybrid already is a part of the antenna, the use of unbalanced hybrids seems to be of little value.

Sequential rotation of and supply to elements can be used as a method of improving the polarization purity in an array of antenna elements. It is a supplement to other methods and only works in the case when the antenna elements are used together with other elements in an array where cross-polarization of different antenna elements can be made to cancel each other at angles close to the broad side direction.

SUMMARY OF THE INVENTION

The object of the invention is to provide an antenna element of the kind mentioned in the introduction, which has a high polarization purity but still has a simple construction.

The present invention may include a ground plane and at least one radiation disc connected to two ports for supplying a desired electromagnetic radiation, preferably within the microwave range, the distance between the ground plane and the radiation disc being a fraction of the wavelength of the radiation.

According to the invention such an antenna element is primarily characterized in that the ports are located at an electrical distance of 90° from each other and that a quarterwave transformer is added between the ground plane and the radiation disc, that is designed such that the transmission line impedance between the ports is reduced to make the ports radiationally independent of each other.

Figure 1:
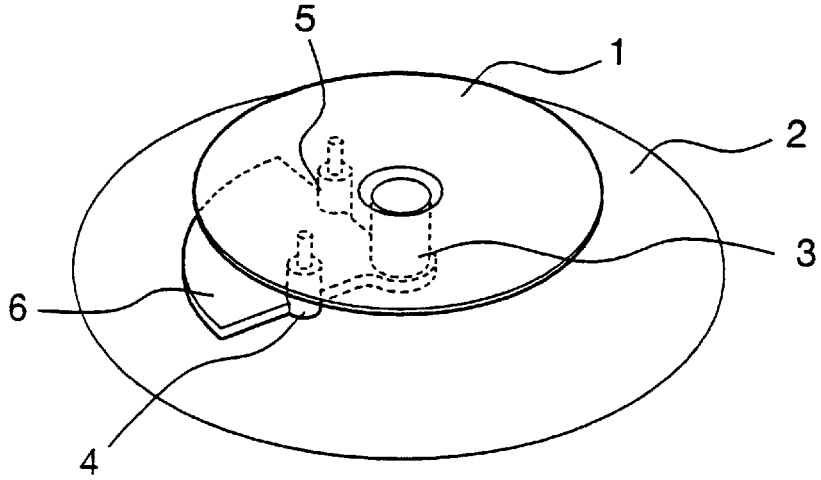
FIG. 1 represents a perspective view of an embodiment of an antenna element according to the present invention.
Figure 2:
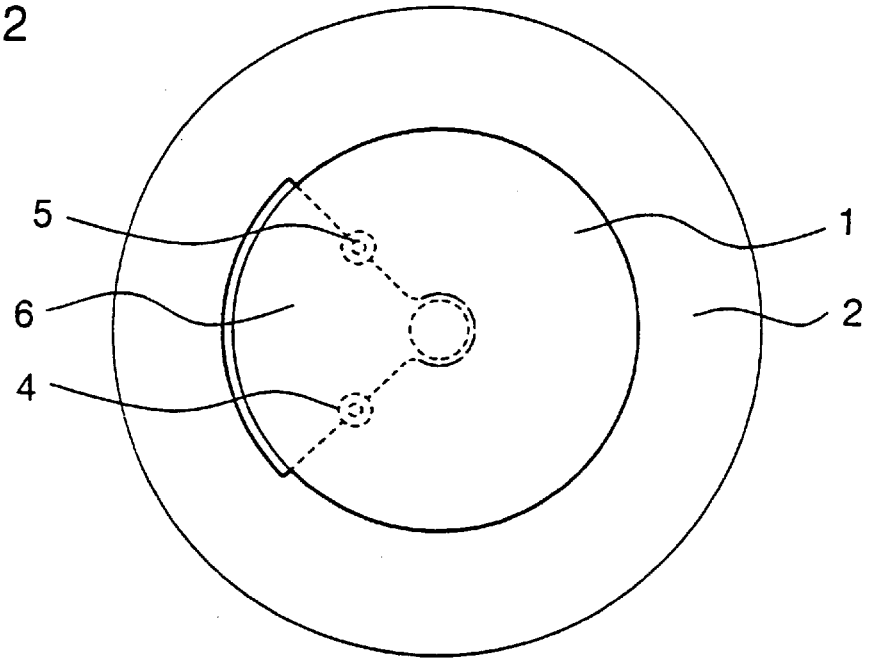
FIG. 2 represents a top view of the embodiment of the antenna element shown in FIG. 1.
Figure 3:
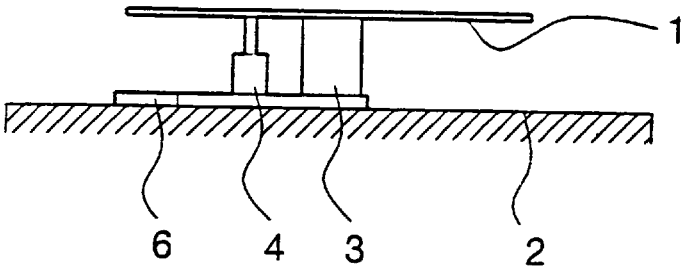
FIG. 3 represents in a side view of the embodiment illustrated in FIGS. 1 and 2.

The quarterwave transformer can be designed in different ways. It can be located as one unit inside the 90° sector between the ports or inside the 270° sector opposite to the ports. It can also consist of two parts, symmetrically located within the 90° sector between the ports and within the 270° sector opposite the ports. In a preferred embodiment the quarterwave transformer is formed of steps in the ground plane at a smaller distance from the radon disc than the rest of the ground plane.

The quarterwave transformer can also consist of steps in the radiation disc located at a smaller distance from the ground plane than the rest of the radiation disc.

The principle underlying the invention can be described in terms of a transmission model of the radiation disc, for example for a circular radiation disc, which is fed at two points that are located geometrically 90° apart from each other. At resonance of the base mode TM11 (H11) the two ports are also electrically separated 90° due to the circumferential $e^{\pm j\theta}$ dependence of the electrical field. The two ports, matched to their transmission lines, result in high impedance resistive loads on the low impedance loss radiation disc transmission line. The impedance at one port is higher as seen in a direction towards an adjacent port than away therefrom, since the load impedance is transformed via the quarterwavelength, which separates the ports. This has the effect that less energy is distributed to the adjacent port than what is distributed in the opposite direction. The $e^{\pm j\theta}$ and $e^{-j\theta}$ components are excited to different amplitudes. That is, an elliptical polarization is excited by one port, which, in an ideal case, would provide a linear polarization.

As a non-limiting exemplary embodiment of an antenna element according to the invention, an antenna element having a circular radiation disc is described below. However, in principle the radiation disc in an antenna element according to the invention can have other shapes. For example, the disc can have rectangular, in particular quadratic shapes. The quarterwave transformer is adapted to the shape of the radiation disc.

In the figures, a circular radiation disc is denoted 1, a ground plane is denoted 2 and a post of a dielectric or metallic material is denoted 3. The post maintains the radiation disc at a distance from the ground plane, which is a fraction of the wavelength λ of the radiation. Two probes 4 and 5 constitute ports for the supply of the present signal to the radiation disc 1. These ports are located geometrically and, thereby, electrically at a 90° distance from each other. In the sector between them, the ground plane is elevated to form an impedance reducing step 6.

By supplying and receiving the corresponding signals respectively through the two ports 4 and 5 a very high polarization purity in all desired orthogonal polarizations is obtained.

An important advantage of the quarterwave transformer, designed as a step in the region between the radiation disc and the ground plane, is that the radiation disc can be adapted and optimized with regard to other parameters before the antenna element is optimized with regard to the requirements of polarization purity. The reason for this is that the impedance steps in general do not effect the electrical magnitude of the radiation disc. However, if instead tongues and cutting-outs were used on the radiation disc in order to achieve polarization purity, all other parameters must be optimized simultaneously.

I claim:

1. An antenna element for transmission and reception of two orthogonal polarizations of electromagnetic radiation having good polarization purity, comprising:

a ground plane;

at least one radiation disk connected to the ground plane;

two ports for supplying microwave range electromagnetic radiation connected to the at least one radiation disk, the two ports are arranged at an electrical distance of 90° from each other; and an impedance reducing step comprising a quarterwave transformer arranged between the ground plane and the at least one radiation disk;

wherein the ground plane and the at least one radiation disk are separated by a distance of a fraction of a wavelength of the microwave range electromagnetic radiation.

2. The antenna element according to claim 1, wherein the radiation disk has a circular shape.

3. The antenna element according to claim 1, wherein the radiation disk has a quadratic shape.

4. The antenna element according to claim 1, wherein the quarterwave transformer is arranged inside the 90° distance between the two ports.

5. The antenna element according to claim 1, wherein the quarterwave transformer is arranged inside a 270° distance opposite the two ports.

6. The antenna elements according to claim 1, wherein the quarterwave transformer comprises one part.

7. The antenna elements according to claim 1, wherein the quarterwave transformer comprises two parts, a first part arranged inside the 90° distance between the two ports and a second part arranged inside a 270° distance opposite the two ports.

8. The antenna element according to claim 1, wherein the quarterwave transformer comprises a plurality of steps in the ground plane arranged closer to the at least one radiation disk than a remainder of the ground plane.

9. The antenna element according to claim 4, wherein the quarterwave transformer comprises a plurality of steps in the ground plane arranged closer to the at least one radiation disk than a remainder of the ground plane.

10. The antenna element according to claim 5, wherein the quarterwave transformer comprises a plurality of steps in the ground plane arranged closer to the at least one radiation disk than a remainder of the ground plane.

11. The antenna element according to claim 7, wherein the quarterwave transformer comprises a plurality of steps in the ground plane arranged closer to the at least one radiation disk than a remainder of the ground plane.

12. The antenna element according to claim 1, wherein the quarterwave transformer comprises a plurality of steps in the at least one radiation disk arranged closer to the ground plane than a remainder of the at least one radiation disk.

13. The antenna element according to claim 4, wherein the quarterwave transformer comprises a plurality of steps in the at least one radiation disk arranged closer to the ground plane than a remainder of the at least one radiation disk.

14. The antenna element according to claim 5, wherein the quarterwave transformer comprises a plurality of steps in the at least one radiation disk arranged closer to the ground plane than a remainder of the at least one radiation disk.

15. The antenna element according to claim 7, wherein the quarterwave transformer comprises a plurality of steps in the at least one radiation disk arranged closer to the ground plane than a remainder of the at least one radiation disk.

* * * * *